US006607104B2

(12) United States Patent
McGuffey

(10) Patent No.: US 6,607,104 B2
(45) Date of Patent: Aug. 19, 2003

(54) METERED OUTPUT HOT MELT ADHESIVE DISPENSING SYSTEM WITH RETURN ISOLATION LOOP

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 195 days.

(21) Appl. No.: 09/864,601

(22) Filed: May 24, 2001

(65) Prior Publication Data

US 2003/0062384 A1 Apr. 3, 2003

(51) Int. Cl.[7] ..... B65D 58/54
(52) U.S. Cl. ..... 222/318; 222/109
(58) Field of Search ..... 222/109, 318, 222/424, 485

(56) References Cited

U.S. PATENT DOCUMENTS 2,800,365 A * 7/1957 Hodges ..... 222/318
4,371,096 A * 2/1983 Scholl et al. ..... 222/318
4,687,137 A 8/1987 Boger et al.
4,779,762 A * 10/1988 Klein et al. ..... 222/133
4,983,109 A 1/1991 Miller et al.
5,000,112 A 3/1991 Rothen et al.
5,236,641 A 8/1993 Allen et al.
5,862,986 A 1/1999 Bolyard, Jr. et al.
6,089,413 A 7/2000 Riney et al.
6,131,770 A * 10/2000 Allen ..... 222/318
6,334,554 B1 * 1/2002 Bolyard, Jr. et al. ..... 222/389

* cited by examiner

*Primary Examiner*—Kenneth Bomberg
(74) *Attorney, Agent, or Firm*—Schwartz & Weinrieb

(57) ABSTRACT

A metered output hot melt adhesive dispensing system comprises a plurality of hot melt adhesive dispensing valve assemblies, and a multiple outlet metering gear pump for supplying hot melt adhesive material to the plurality of valve assemblies. Return ports of the valve assemblies are fluidically connected to the intake side of the multiple outlet metering gear pump through a plurality of return conduits and a common return line. A single output return metering gear pump is disposed within the common return line and has operatively associated therewith a recirculation bypass loop within which a spring-biased one-way check valve is disposed. The system relieves excess pressure buildup within the valve assemblies so as to substantially prevent the occurrence of bursting and stringing phenomena attendant cyclically intermittent OPENED and CLOSED states of the plurality of valve assemblies.

18 Claims, 2 Drawing Sheets

METERED OUTPUT HOT MELT ADHESIVE DISPENSING SYSTEM WITH RETURN ISOLATION LOOP

CROSS-REFERENCE TO RELATED PATENT APPLICATIONS

This patent application is related to U.S. patent application Ser. No. 09/821,476 filed on Mar. 29, 2001 in the name of Grant McGuffey and entitled SNUFFBACK-DIVERSION FLOW VALVE SYSTEM, and to U.S. patent application Ser. No. 09/550,884 filed on Apr. 17, 2000 in the name of Edward W. Bolyard, Jr. and entitled IMPROVED SNUFFBACK VALVE FOR HOT MELT ADHESIVE.

FIELD OF THE INVENTION

The present invention relates generally to hot melt adhesive dispensing systems, and more particularly to a new and improved hot melt adhesive dispensing system which comprises a multiple-outlet metering gear pump for supplying hot melt adhesive to a plurality of snuffback-diversion flow valves, and wherein the system further comprises the use of a single return metering gear pump disposed within a return loop fluidically interconnecting the plurality of snuffback-diversion flow valves to the multiple-outlet metering gear pump such that inconsistent dispensing or bursting of the hot melt adhesive, characteristically present upon the commencement of a hot melt adhesive dispensing operation or cycle, is essentially eliminated, and in addition, quick shutoff, and proper pressure and volumetric control, of the adhesive supply internally within the valve assembly is able to be achieved at the termination of a hot melt adhesive dispensing operation or cycle, and particularly during the closure of the snuffback valve, such that the undesirable stringing of the adhesive does not occur within such a multiple-outlet metering gear pump system.

BACKGROUND OF THE INVENTION

In connection with the dispensing of highly-viscous materials, such as, for example, hot melt adhesives, it is imperative that the dispensing system comprise what is known in the art as a snuffback valve by means of which the shutoff or termination of the dispensed adhesive is readily achieved upon closure of the valve whereby stringing of the adhesive does not occur. As disclosed within the aforenoted previously filed patent application, U.S. patent application Ser. No. 09/550,884, prior art snuffback valves, while certainly being capable of substantially performing their basic operations of controlling and preventing the dispensing of hot melt adhesives, nevertheless suffered several operational drawbacks or disadvantages, such as, for example, being relatively slow-acting, and permitting the aforenoted undesirable stringing of the hot melt adhesive materials upon termination of a hot melt adhesive dispensing cycle. In addition, due to the particular structural characteristics of such conventional or prior art snuffback valves, the dispensing systems would also experience or exhibit a phenomenon known as bursting wherein, upon commencement of a new adhesive dispensing operation or cycle, a sudden expulsion, discharge, or dispensing of a predetermined amount or glob of adhesive would occur.

Accordingly, by means of the particularly new and novel structure of the snuffback valve as disclosed within the aforenoted previously filed patent application, U.S. patent application Ser. No. 09/550,884, the aforenoted operational problems, drawbacks, and disadvantages characteristic of the conventional or prior art snuffback valves have been addressed and have been substantially reduced or rectified. It was determined still further, however, that some of the aforenoted problems characteristic of the prior art snuffback valves, such as, for example, bursting and stringing, nevertheless persisted to some degree within current hot melt adhesive dispensing systems despite the structural improvements, modifications, and refinements made to the snuffback valves in accordance with the teachings and principles of the invention embodiments as disclosed within the previously filed patent application, U.S. patent application Ser. No. 09/550,884. The reason for this is that the problems or operational drawbacks or disadvantages were no longer based or founded upon structural characteristics of the snuffback valve per se, but to the contrary, were believed to be based upon, or caused by, pressure and volumetric parameters characteristic of the hot melt adhesive dispensing system per se.

Accordingly, by means of the new and improved combination diversion-snuffback flow valve system disclosed within the aforenoted U.S. patent application Ser. No. 09/550,884 filed on Apr. 17, 2000 , a diversion valve was integrally incorporated into the snuffback valve system wherein the pressure and volumetric parameters of the valve system were able to be advantageously predetermined and controlled such that the valve mechanism was rendered relatively fast-acting, and wherein further, bursting and stringing of the hot melt adhesive materials, upon commencement and termination of a particular hot melt adhesive dispensing operation or cycle, were respectively prevented or significantly reduced. It is noted, however, that the system disclosed within the aforenoted U.S. patent application Ser. No. 09/550,884 filed on Apr. 17, 2000 comprises what is known in the art as a pressurized hot melt adhesive dispensing system, however, hot melt adhesive dispensing systems may also comprise what is known in the art as a metered output hot melt adhesive dispensing system. During the operation of such metered output hot melt adhesive dispensing systems, in a manner similar to the operation of pressurized hot melt adhesive dispensing systems, it is often imperative or desired to cycle the dispensing of the adhesive material output from the gearhead in ON and OFF modes by suitably actuating the combination diversion-snuffback valve assemblies. Accordingly, it is likewise imperative that, in conjunction with the operational cycling of such metered output hot melt adhesive dispensing systems, the aforenoted dispensing problems comprising stringing and bursting must likewise be addressed and rectified whereby such metered output hot melt adhesive dispensing systems will not exhibit undesirable stringing and bursting characteristics.

Accordingly, a need exists in the art for a new and improved metered output hot melt adhesive dispensing system wherein the pressure and volumetric parameters can be advantageously predetermined and controlled such that the undesirable phenomena of bursting and stringing of the hot melt adhesive materials, upon commencement and termination of hot melt adhesive dispensing operations or cycles in accordance with the ON and OFF or OPEN and CLOSED modes of the combination snuff-back-diversion flow valves, are respectively prevented or significantly reduced.

OBJECTS OF THE INVENTION

Accordingly, it is an object of the present invention to provide a new and improved metered output hot melt adhesive dispensing system.

Another object of the present invention is to provide a new and improved metered output hot melt adhesive dispensing system which effectively overcomes the various operational disadvantages and drawbacks characteristic of conventional or prior art metered output hot melt adhesive dispensing systems.

An additional object of the present invention is to provide a new and improved metered output hot melt adhesive dispensing system which effectively overcomes the various operational disadvantages and drawbacks characteristic of conventional or prior art metered output hot melt adhesive dispensing systems by the inclusion, within a metered output hot melt adhesive dispensing system comprising a multiple-output metering gear pump which supplies hot melt adhesive material to a plurality of combination snuffback-diversion flow valves, of a return loop which has a single return metered output gear pump disposed therein for with-drawing a predetermined volumetric amount of hot melt adhesive material from the snuffback-diversion flow valves when one or more of the snuffback-diversion flow valves is disposed in its non-discharging or non-dispensing OFF mode so as to relieve back-pressure or pressure buildup parameters with respect to the snuffback-diversion flow valves.

A further object of the present invention is to provide a new and improved metered output hot melt adhesive dispensing system which effectively overcomes the various operational disadvantages and drawbacks characteristic of conventional or prior art metered output hot melt adhesive dispensing systems by the inclusion, within a metered output hot melt adhesive dispensing system comprising a multiple-output metering gear pump which supplies hot melt adhesive material to a plurality of combination snuffback-diversion flow valves, of a return loop which has a single return metered output gear pump disposed therein for withdrawing a predetermined volumetric amount of hot melt adhesive material from the snuffback-diversion flow valves when one or more of the snuffback-diversion flow valves is disposed in its non-discharging or non-dispensing OFF mode so as to relieve back-pressure or pressure buildup parameters with respect to the snuffback-diversion flow valves such that the phenomena of stringing and bursting do not occur, or are significantly reduced, when the snuffback-diversion flow valves are operationally cycled in accordance with intermittently actuated ON and OFF states or modes of operation.

SUMMARY OF THE INVENTION

The foregoing and other objectives are achieved in accordance with the teachings and principles of the present invention through the provision of a new and improved metered output hot melt adhesive dispensing system which comprises a multiple outlet metering gear pump which supplies hot melt adhesive material to a plurality of snuffback-diversion flow valves through means of a laminated gear head, and wherein further, there is provided a return loop fluidically connecting the plurality of snuffback-diversion flow valves back to the inlet side of the multiple outlet gear pump. A single return metering gear pump is disposed within the return loop, and the single return metering gear pump has a check-valve controlled recirculation loop fluidically connected thereto such that the recirculation loop fluidically connects the inlet and outlet sides of the single return metering gear pump. In this manner, significant back-pressure or pressure-buildup parameters upon the upstream or non-dispensing ends of the snuffback-diversion flow valves are effectively relieved or eliminated so as to effectively prevent or eliminate the phenomena of bursting and stringing as the snuffback-diversion flow valves are operationally cycled in accordance with intermittently actuated ON and OFF or OPEN and CLOSED states or modes of operation.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
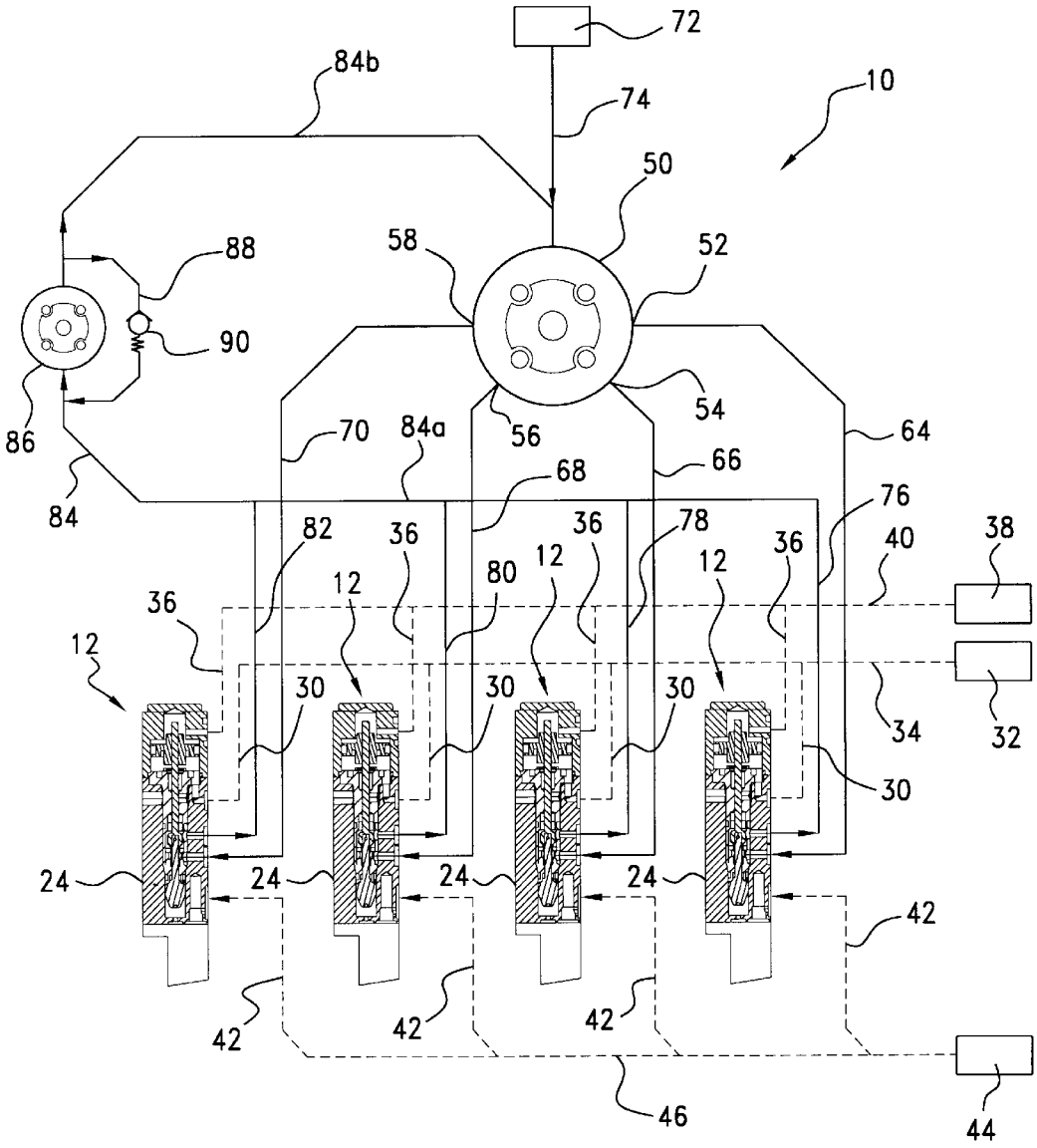
FIG. 1 is a schematic diagram illustrating the new and improved metered output hot melt adhesive dispensing system constructed in accordance with the principles and teachings of the present invention and showing the relative arrangement of the various component parts thereof.

Referring now to the drawings, and more particularly to FIG. 1 thereof, the new and improved metered output hot melt adhesive dispensing system, constructed in accordance with the principles and teachings of the present invention and showing the relative arrangement of the various component parts thereof, is disclosed and is generally indicated by the reference character 10. As can readily be seen, the new and improved metered output hot melt adhesive dispensing system 10, constructed in accordance with the principles and teachings of the present invention, comprises a plurality of combination snuffback-diversion flow valve assemblies 12, wherein each one of such combination snuffback-diversion flow valves is similar to the combination snuffback-diversion flow valve disclosed within the aforenoted U.S. patent application Ser. No. 09/550,884 filed on Apr. 17, 2000, and wherein further, the disclosure of such patent application is hereby incorporated by reference in its entirety.

Figure 2:
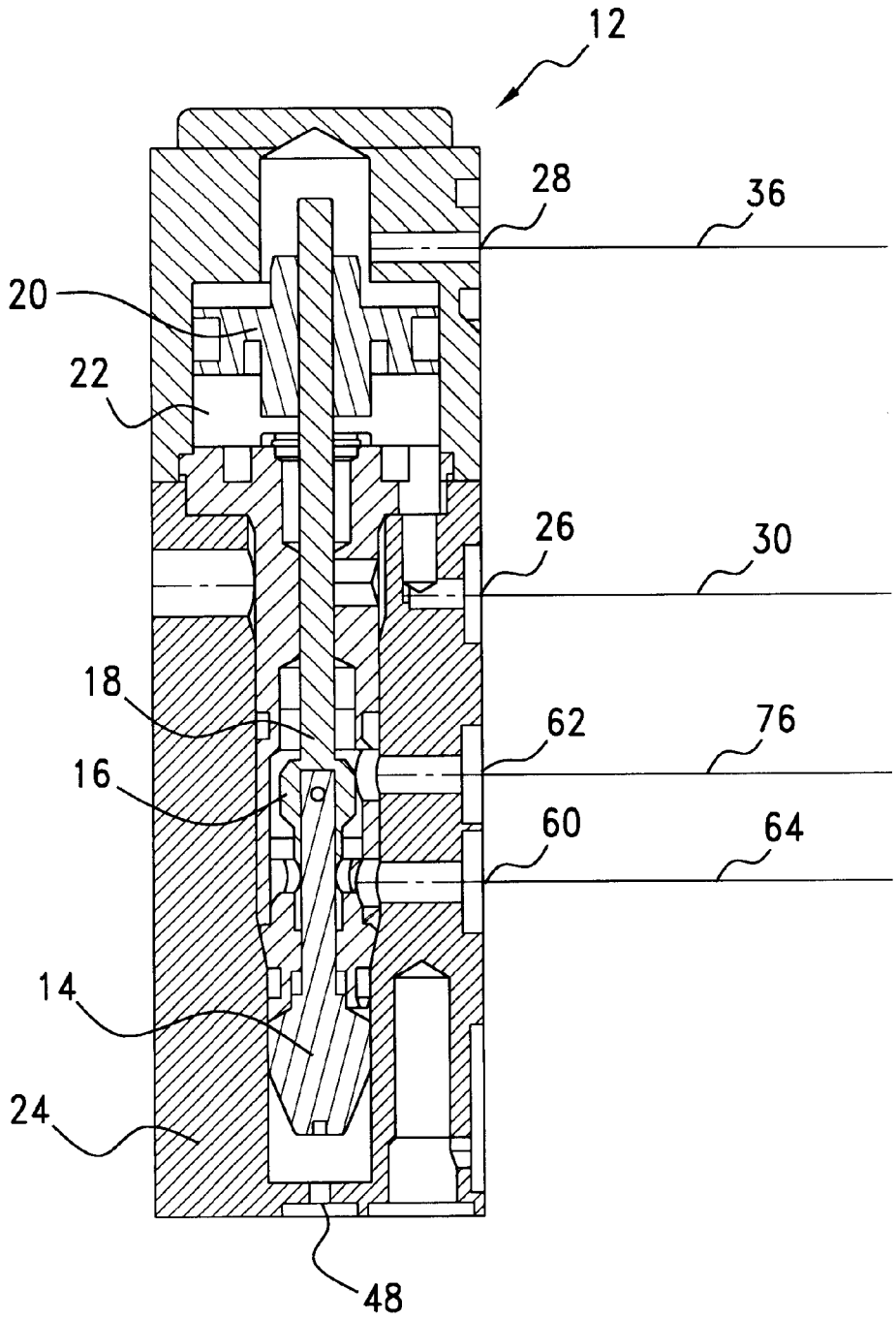
FIG. 2 is an enlarged cross-sectional view of one of the plurality of combination snuffback-diversion flow valves as utilized within the metered output hot melt adhesive dispensing system illustrated in FIG. 1.

More particularly as best seen with additional reference being made to FIG. 2, but briefly for the purpose of facilitating a better understanding of the new and improved metered output hot melt adhesive dispensing system 10 constructed in accordance with the principles and teachings of the present invention, each one of the combination snuffback-diversion flow valve assemblies 12 comprises a snuffback valve 14 which is adapted to be vertically movable between OPEN and CLOSED positions with respect to its valve seat, not numbered for clarity purposes, and a diversion flow valve 16 which is integrally connected to the snuffback valve 14 and which is also adapted to be vertically movable between OPEN and CLOSED positions with respect to its valve seat, also not numbered for clarity purposes. Each diversion flow valve 16 is provided with a vertically upstanding valve stem 18, and the upper end portion of each valve stem 18 has a piston 20 fixedly mounted thereon. Each piston 20 is movably disposed within a piston chamber 22 defined within the upper end portion of the snuffback-diversion flow valve body or module 24, and in order to actuate each piston 20 so as to move the same upwardly and downwardly which, in turn, will cause corresponding vertical movement of each diversion flow-snuffback valve assembly 12, each diversion flow-snuffback valve body or module 24 is further provided with a CLOSE control air inlet port 26 and an OPEN control air inlet port 28.

Each CLOSE control air inlet port 26 is respectively pneumatically connected to a CLOSE air pneumatic control line 30 along which CLOSE control air signals are able to be respectively transmitted from a source of CLOSE control air 32 by means of a common CLOSE air control line 34, and each OPEN control air inlet port 28 is respectively pneumatically connected to an OPEN air pneumatic control line 36 along which OPEN control air signals are able to be respectively transmitted from a source of OPEN control air 38 by means of a common OPEN air control line 40. In this manner, CLOSE and OPEN control air signals are able to be used for accordingly acting upon opposite sides of the piston 20 in order to vertically actuate the same. Still further, a plurality of process air INLET lines are also disclosed at 42 for providing process or pattern control air from a source of process or pattern control air 44, through means of a common process or pattern control air line 46, to each one of the diversion flow-snuffback valve bodies or modules 24. In this manner, process or pattern control air streams are provided for interacting with the hot melt adhesive materials, which are being discharged from suitable hot melt adhesive material discharge ports 48 formed within the lowermost end portions of the valve bodies or modules 24 of the snuffback valve-diversion flow valve assemblies 12, in a well-known manner.

As has been noted hereinbefore, the new and improved hot melt adhesive dispensing system 10, constructed in accordance with the principles and teachings of the present invention, comprises a metered output hot melt adhesive dispensing system, and accordingly, the metered output hot melt adhesive dispensing system 10 of the present invention is seen to further comprise a multiple outlet metering gear pump 50 which, as is well-known in the art, pumps, dispenses, or discharges precise amounts of output materials. More particularly, while a multiple outlet metering gear pump, such as, for example, multiple outlet metering gear pump 50, may have various different number of outlets, such as, for example, two, four, six, eight, or twelve outputs, the multiple outlet metering gear pump 50 used within the metered output hot melt adhesive dispensing system 10 of the present invention is seen to comprise four pump outlets 52,54,56,58. As best seen again from FIG. 2, each one of the combination snuffback-diversion flow valve assemblies 12 is further provided with a hot melt adhesive supply port 60 and a hot melt adhesive return port 62, and it is further seen that each one of the four pump outlets 52,54,56,58 is respectively fluidically connected to each one of the hot melt adhesive supply ports 60 of the snuffback-diversion flow valve assemblies 12 by means of fluid conduits schematically shown at 64,66,68,70. The multiple outlet metering gear pump 50 is supplied with adhesive material from a suitable adhesive material supply unit 72 through means of an adhesive material supply line 74, and it is noted that the line pressure within the adhesive material supply line 74 is 290 psi. It is further noted that the precisely metered amount of adhesive material discharged by means of the multiple outlet metering gear pump 50 from each one of the four pump outlets 52,54,56,58 is 0.6 cc per revolution, and therefore the total amount of adhesive material discharged by means of the multiple outlet metering gear pump 50 per revolution comprises 2.4 cc of adhesive material.

Each one of the hot melt adhesive material return ports 62 of the snuffback-diversion flow valve assemblies 12 is respectively fluidically connected to a hot melt adhesive material return conduit 76,78,80,82, and the hot melt adhesive material return conduits 76,78,80,82 are in turn fluidically to a common hot melt adhesive material return line 84 which is also fluidically connected at its opposite end to the adhesive material supply line 74 so as to in effect define a hot melt adhesive material return loop. As has been noted hereinbefore, in accordance with the particularly operational objectives of the metered output hot melt adhesive dispensing system 10 which are addressed by means of the principles and teachings of the present invention, it is particularly desirable to effectively prevent a buildup of pressure, or the development of backpressure conditions, upon the hot melt adhesive material supply or upstream side of the snuffback valve portions of the combination snuffback-diversion flow valve assemblies 12 in order to effectively prevent or alleviate the occurrence of bursting and stringing phenomena attendant the cyclical opening and closing of the snuffback valve portions of the combination snuffback-diversion flow valve assemblies 12. Accordingly, it follows that it is further desirable to effectively provide a viable return flow path for such hot melt adhesive material through the diversion flow valve portions of the combination snuffback-diversion flow valve assemblies 12 such that the hot melt adhesive material can in effect flow away from the snuffback valve portions of the combination snuffback-diversion flow valve assemblies 12 other than when actual discharge or dispensing of hot melt adhesive material from the discharge ports 48 is actually desired and implemented.

In accordance then with the particularly unique and novel principles and teachings of the present invention, the metered output hot melt adhesive dispensing system 10 of the present invention is seen to further comprise a single output return metering gear pump 86 which is incorporated within the hot melt adhesive material return loop 84 such that the intake side or suction end of the single output return metering gear pump 86 is fluidically connected to, or disposed toward, the combination snuffback-diversion flow valve assemblies 12 by means of an upstream portion **84*a* of the return loop 84, while the output side or discharge end of the single output return metering gear pump 86 is fluidically connected to or disposed toward the adhesive material supply line 74 for the multiple output metering gear pump 50 by means of a downstream portion 84*b* of the return loop 84. In addition to the single output return metering gear pump 86, a recirculation loop 88 is disposed around the single output return metering gear pump 86 such that the recirculation loop 88 fluidically connects the intake and output sides of the single output return metering gear pump 86. It is also to be noted that the recirculation loop 88 has a spring-biased one-way check valve 90 incorporated therein, wherein the check valve 90 will fluidically open the recirculation loop 88 so as to permit fluid flow therethrough when the operating or crack pressure within the recirculation loop 88** is 300 psi.

In view of the fact that the line pressure within the downstream return loop portion **84*b*, as well as within the portion of recirculation loop 88 which is disposed upstream of the check valve 90, is 290 psi, only an additional prevailing pressure of 10 psi is required to open the check valve 90 against the biasing force of its spring and permit fluid flow through the recirculation loop 88. It is further noted that the metered output or throughput of the single output return metering gear pump 86 is 3 cc per revolution. Accordingly, it can be readily appreciated that as a result of the incorporation of the single output return metering gear pump 86 within the adhesive material recirculating flow system of the metered output hot melt adhesive dispensing system 10 of the present invention, the amount of fluid flow throughput of the single output return metering gear pump 86, which comprises the aforenoted 3 cc per revolution, is greater, by means of 0.6 cc per revolution, than the combined fluid output of 2.4 cc per revolution from the four outlets 52,54,56,58 of the adhesive material metering gear pump 50**.

Accordingly, in operation, when, for example, all of the combination snuffback-diversion flow valve assemblies 12 are disposed in their CLOSED states, as a result of a CLOSED air signal being transmitted along CLOSE air signal lines 34,30 from CLOSE air supply source 32, no hot melt adhesive material is being discharged from any one of the snuffback-diversion flow valve assemblies 12 and the hot melt adhesive material outputted or discharged from multiple output metering gear pump 50 is simply, in effect, conducted along supply lines or fluid conduits 64,66,68,70, conducted through the snuffback-diversion flow valve assemblies 12, and recirculated back out of or from the snuffback-diversion flow valve assemblies 12 along the return conduits 76,78,80, 82 to the return loop 84. It is to be remembered that the cumulative output of the multiple output metering gear pump 50 comprises 2.4 cc per revolution, and since no adhesive material is being discharged from any of the output ports 48 of the snuffback-diversion flow valve assemblies 12, a total amount of 2.4 cc per revolution of hot melt adhesive material is being conducted through the snuffback-diversion flow valve assemblies 12 and into the return conduits 76,78,80,82 and return loop 84. It is also to be remembered that the single output return metering gear pump 86 has a metered volumetric throughput of 3 cc per revolution, and therefore, since the multiple outlet metering gear pump 50 and the single output return metering gear pump 86 are driven by means of the same drive system at the same rotary speed such that one revolution per minute of the multiple output metering gear pump 50 is the same as one revolution per minute of the single output return metering gear pump 86, the adhesive material volumetric throughput of the single output return metering gear pump 86 is greater than the adhesive material volumetric output of the multiple output metering gear pump 50 and the amount of adhesive material conducted along the return lines or conduits 76,78,80,82 and return loop 84. Accordingly, since the upstream portion 84*a* of return loop 84, which is fluidically connected to the return lines or conduits 76,78,80,82, is also fluidically connected to the suction or intake side of the single output return metering gear pump 86, a predetermined amount of suction or negative pressure is effectively created or developed within such up-stream portion 84*a* of the return loop 84 which is fluidically connected to the return lines or conduits 76,78, 80,82.

It is precisely this suction or negative pressure which effectively acts upon the hot melt adhesive material supply or upstream side of the snuffback valve portions of the combination snuffback-diversion flow valve assemblies 12 so as to effectively prevent a buildup of pressure, or the development of back pressure conditions, in order to effectively prevent or alleviate the occurrence of bursting and stringing phenomena attendant the cyclical opening and closing of the snuffback valve portions of the combination snuffback-diversion flow valve assemblies 12. It is noted further that as a result of the creation or development of such suction or negative pressure, a sufficient amount of negative pressure, on the order of at least 10 psi, is in effect impressed upon the spring-loaded check valve 90 within the recirculation or bypass loop 88 such that when, in effect, such negative pressure is added to the line pressure of 290 psi within the downstream return loop portion 84*b*, check valve 90 is opened and recirculation flow of adhesive material through recirculation or bypass loop 88 is permitted. This flow of adhesive material through recirculation or bypass loop 88 also makes up for the volumetric flow deficit of adhesive material through the single output return metering gear pump 86. More particularly, since only 2.4 cc of adhesive material is flowing within upstream portion 84*a* of the return loop per revolution of the multiple outlet metering gear pump 50 in accordance with the flow of the adhesive material through the combination snuffback-diversion flow valve assemblies 12, while the flow throughput of the single output return metering gear pump 86 is 3 cc per revolution, a deficit of 0.6 cc of adhesive material is effectively and necessarily withdrawn from recirculation or bypass loop 88, added to the incoming flow from upstream return loop portion 84*a*, and outputted by means of single output return metering gear pump 86. On the output or discharge side of the single output return metering gear pump 86, 2.4 cc per revolution of the adhesive material is conducted into the downstream portion 84*b* of return loop 84 for return to the multiple outlet metering gear pump supply line 74, while 0.6 cc of the adhesive material is recirculated again back through the recirculation or bypass line 88 so as to be added to the next 2.4 cc volumetric batch of adhesive material being taken in by the single output return metering gear pump 86 from the upstream portion 84*a* of the return loop 84.

In the event that one or more of the combination snuffback-diversion flow valve assemblies 12 is OPENED, as opposed to all of the combination snuffback-diversion flow valve assemblies 12 being disposed in their CLOSED states as noted hereinbefore, then the hot melt adhesive material which is supplied to the OPENED ones of the combination snuffback-diversion flow valve assemblies 12 is of course discharged or dispensed, while the hot melt adhesive material which is supplied to a CLOSED one of the combination snuffback-diversion flow valve assemblies 12 is of course conducted back through the return loop 84. Since the volumetric amount of adhesive material conducted back through the return loop 84 is now less than the normal total amount of adhesive material supplied by means of the multiple output metering gear pump 50, that is, less than 2.4 cc per revolution of the gear pump 50, because some of the outputted adhesive material is being discharged by means of one or more of the combination snuffback-diversion flow valve assemblies 12, the single output return metering gear pump 86 will still likewise intake the necessary volumetric deficit of adhesive material from the recirculation or bypass loop 88.

For example, if two of the combination snuffback-diversion flow valve assemblies 12 are CLOSED and two of the combination snuffback-diversion flow valve assemblies 12 are OPENED, then 1.2 cc of adhesive material per revolution will be dispensed while only 1.2 cc of adhesive material per revolution will be returned along return loop portion 84*a* toward the single output return metering gear pump 86. The single output return metering gear pump 86 must, however, necessarily throughput 3 cc of adhesive material per revolution, and accordingly, the single output return metering gear pump 86 will take in 1.8 cc of adhesive material per revolution from the recirculation or bypass loop 88. On the output side of the single output return metering gear pump 86, 1.2 cc of adhesive material will be conducted into the downstream return loop portion 84*b* while 1.8 cc of adhesive material will in effect be returned to recirculation or bypass loop 88 for reuse with the next 1.2 volumetric batch of adhesive material conducted toward single output return metering gear pump 86 along upstream return loop portion 84*a*. In a similar manner, when all of the combination snuffback-diversion flow valve assemblies 12 are disposed in their OPENED states, all of the adhesive material outputted from multiple output metering gear pump 50 is conducted through the combination snuffback-diversion flow valve assemblies 12 and discharged or dispensed, and accordingly, no adhesive material is conducted along upstream return loop portion 84*a* toward the single output return metering gear pump 86. In this state or condition, the single output return metering gear pump 86 will take in a volumetric amount of 3 cc of adhesive material per revolution from recirculation or bypass loop 88, as deerived from downstream return loop portion 84*b*, and on the output side of the single output return metering gear pump 86, the outputted adhesive material will simply be recirculated through recirculation or bypass loop 88.

Thus, it may be seen that in accordance with the principles and teachings of the present invention, there has been provided a new and improved metered output hot melt adhesive dispensing system wherein the pressure and volumetric parameters can be advantageously predetermined and controlled such that the undesirable phenomena of bursting and stringing of the hot melt adhesive materials, upon commencement and termination of hot melt adhesive dispensing operations or cycles in accordance with the ON and OFF, or OPEN and CLOSED, modes of the combination snuff-back-diversion flow valves, are respectively prevented or significantly reduced.

Obviously, many variations and modifications of the present invention are possible in light of the above teachings. For example, more than one multiple outlet metering gear pump may be employed within the system, as may more than one single output return metering gear pump. It is therefore to be understood that within the scope of the appended claims, the present invention may be practiced otherwise than as specifically described herein.

What is claimed as new and desired to be protected by Letters Patent of the United States of America, is:

1. A material dispensing system, comprising:

a plurality of valve assemblies for dispensing a material from each one of said plurality of valve assemblies when a particular one of said plurality of valve assemblies is disposed in an OPENED state;

a multiple outlet metering gear pump for supplying a predetermined amount of material from a material supply source to each one of said plurality of valve assemblies;

a plurality of material supply conduits respectively fluidically interconnecting each outlet of said multiple outlet metering gear pump to said plurality of valve assemblies so as to supply said plurality of valve assemblies with material to be dispensed;

a plurality of return conduits respectively fluidically interconnecting said plurality of valve assemblies, through means of a common return line, to an intake side of said multiple outlet metering gear pump so as to return material to said intake side of said multiple outlet metering gear pump when a particular one of said plurality of valve assemblies is disposed in a CLOSED state; and a single output return metering gear pump disposed within said common return line for developing negative pressure conditions within said common return line and said plurality of return conduits fluidically connected to said plurality of valve assemblies so as to prevent pressure buildup conditions within any one of said plurality of valve assemblies in order to substantially prevent the occurrence of bursting and stringing phenomena attendant cyclically intermittent OPENED and CLOSED states of said plurality of valve assemblies.

2. The system as set forth in claim 1, wherein:

said multiple outlet metering gear pump comprises four outlets; and said plurality of valve assemblies comprises four valve assemblies.

3. The system as set forth in claim 1, wherein:

each one of said plurality of valve assemblies comprises a combination of a snuffback valve and a diversion flow valve integrally connected to said snuffback valve.

4. The system as set forth in claim 2, wherein:

said multiple outlet metering gear pump has a volumetric output from each one of said multiple outputs of 0.6 cc of material per revolution such that the total volumetric output of said multiple outlet metering gear pump is 2.4 cc of material per revolution; and said single output return metering gear pump has a volumetric output of 3.0 cc of material per revolution.

5. The system as set forth in claim 4, further comprising:

a recirculation bypass loop fluidically connected to said common return line upon opposite sides of said single output metering gear pump; and a spring-biased one-way check valve disposed within said recirculation bypass loop.

6. The system as set forth in claim 5, wherein:

said material supply source supplies material to said multiple outlet metering gear pump at a pressure of 290 psi;

a portion of said common return line fluidically interconnecting said recirculation bypass loop to said multiple outlet metering gear pump, as well as a portion of said recirculation bypass loop disposed upstream of said spring-biased one-way check valve, is at a positive pressure value of 290 psi; and said spring-biased one-way check valve has a crack pressure of 300 psi, whereby operation of said single output return metering gear pump generates a negative pressure value of at least 10 psi within a portion of said recirculation bypass loop disposed downstream of said spring-biased one-way check valve so as to cooperate with said positive pressure value of 290 psi within said portion of said recirculation bypass loop disposed upstream of said spring-biased one-way check valve so as to open said one-way check valve and permit flow of material through said recirculation bypass loop.

7. The system as set forth in claim 5, wherein:

said single output return metering gear pump necessarily intakes a volumetric deficit of 0.6 cc of material per revolution from said recirculation bypass loop when all of said plurality of valve assemblies are respectively disposed at their CLOSED states since all of the material outputted by said multiple outlet metering gear pump and conducted to said plurality of valve assemblies is returned toward said multiple outlet metering gear pump by said plurality of return conduits and said common return line.

8. The system as set forth in claim 7, wherein:

said single output return metering gear pump necessarily intakes an additional volumetric deficit of 0.6 cc of material per revolution from said recirculation bypass loop for each one of said plurality of valve assemblies which are respectively disposed at their OPENED states since all of the material outputted by said multiple outlet metering gear pump and conducted to said plurality of valve assemblies disposed at their OPENED states is not returned toward said multiple outlet metering gear pump by said plurality of return conduits and said common return line.

9. The system as set forth in claim 8, wherein:

said single output return metering gear pump necessarily intakes a total volumetric deficit of 3.0 cc of material per revolution from said recirculation bypass loop when all of said plurality of valve assemblies are respectively disposed at their OPENED states since all of the material outputted by said multiple outlet metering gear pump and conducted to said plurality of valve assemblies disposed at their OPENED states is discharged and not returned toward said multiple outlet metering gear pump by said plurality of return conduits and said common return line.

10. A hot melt adhesive material dispensing system, comprising:

a plurality of valve assemblies for dispensing a hot melt adhesive material from each one of said plurality of valve assemblies when a particular one of said plurality of valve assemblies is disposed in an OPENED state;

a multiple outlet metering gear pump for supplying a predetermined amount of hot melt adhesive material from a hot melt adhesive material supply source to each one of said plurality of valve assemblies;

a plurality of hot melt adhesive material supply conduits respectively fluidically interconnecting each outlet of said multiple outlet metering gear pump to said plurality of valve assemblies so as to supply said plurality of valve assemblies with hot melt adhesive material to be dispensed;

a plurality of return conduits respectively fluidically interconnecting said plurality of valve assemblies, through means of a common return line, to an intake side of said multiple outlet metering gear pump so as to return hot melt adhesive material to said intake side of said multiple outlet metering gear pump when a particular one of said plurality of valve assemblies is disposed in a CLOSED state; and a single output return metering gear pump disposed within said common return line for developing negative pressure conditions within said common return line and said plurality of return conduits fluidically connected to said plurality of valve assemblies so as to prevent pressure buildup conditions within any one of said plurality of valve assemblies in order to substantially prevent the occurrence of bursting and stringing phenomena attendant cyclically intermittent OPENED and CLOSED states of said plurality of valve assemblies.

11. The system as set forth in claim 10, wherein:

said multiple outlet metering gear pump comprises four outlets; and said plurality of valve assemblies comprises four valve assemblies.

12. The system as set forth in claim 10, wherein:

each one of said plurality of valve assemblies comprises a combination of a snuffback valve and a diversion flow valve integrally connected to said snuffback valve.

13. The system as set forth in claim 11, wherein:

said multiple outlet metering gear pump has a volumetric output from each one of said multiple outputs of 0.6 cc of material per revolution such that the total volumetric output of said multiple outlet metering gear pump is 2.4 cc of hot melt adhesive material per revolution; and said single output return metering gear pump has a volumetric output of 3.0 cc of hot melt adhesive material per revolution.

14. The system as set forth in claim 13, further comprising:

a recirculation bypass loop fluidically connected to said common return line upon opposite sides of said single output metering gear pump; and a spring-biased one-way check valve disposed within said recirculation bypass loop.

15. The system as set forth in claim 14, wherein:

said hot melt adhesive material supply source supplies hot melt adhesive material to said multiple outlet metering gear pump at a pressure of 290 psi;

a portion of said common return line fluidically interconnecting said recirculation bypass loop to said multiple outlet metering gear pump, as well as a portion of said recirculation bypass loop disposed upstream of said spring-biased one-way check valve, is at a positive pressure value of 290 psi; and said spring-biased one-way check valve has a crack pressure of 300 psi, whereby operation of said single output return metering gear pump generates a negative pressure value of at least 10 psi within a portion of said recirculation bypass loop disposed downstream of said spring-biased one-way check valve so as to cooperate with said positive pressure value of 290 psi within said portion of said recirculation bypass loop disposed upstream of said spring-biased one-way check valve so as to open said one-way check valve and permit flow of hot melt adhesive material through said recirculation bypass loop.

16. The system as set forth in claim 14, wherein:

said single output return metering gear pump necessarily intakes a volumetric deficit of 0.6 cc of hot melt adhesive material per revolution from said recirculation bypass loop when all of said plurality of valve assemblies are respectively disposed at their CLOSED states since all of the hot melt adhesive material outputted by said multiple outlet metering gear pump and conducted to said plurality of valve assemblies is returned toward said multiple outlet metering gear pump by said plurality of return conduits and said common return line.

17. The system as set forth in claim 16, wherein:

said single output return metering gear pump necessarily intakes an additional volumetric deficit of 0.6 cc of hot melt adhesive material per revolution from said recirculation bypass loop for each one of said plurality of valve assemblies which are respectively disposed at their OPENED states since all of the hot melt adhesive material outputted by said multiple outlet metering gear pump and conducted to said plurality of valve assemblies disposed at their OPENED states is not returned toward said multiple outlet metering gear pump by said plurality of return conduits and said common return line.

18. The system as set forth in claim 17, wherein:

said single output return metering gear pump necessarily intakes a total volumetric deficit of 3.0 cc of hot melt adhesive material per revolution from said recirculation bypass loop when all of said plurality of valve assemblies are respectively disposed at their OPENED states since all of the hot melt adhesive material outputted by said multiple outlet metering gear pump and conducted to said plurality of valve assemblies disposed at their OPENED states is discharged and not returned toward said multiple outlet metering gear pump by said plurality of return conduits and said common return line.

* * * * *